US005399009A

United States Patent [19]

Hiner

[11] Patent Number: 5,399,009

[45] Date of Patent: Mar. 21, 1995

[54] TRANSPORTABLE EASEL

[76] Inventor: Richard M. Hiner, 244 Lion La., Shoreview, Minn. 55126

[21] Appl. No.: 74,202

[22] Filed: Jun. 9, 1993

[51] Int. Cl.[6] ..... A47B 97/04

[52] U.S. Cl. ..... 312/231; 248/461; 312/244

[58] Field of Search ..... 312/240, 244, 231, 258; 248/126, 166, 447, 455, 460, 461, 462, 463, 464; 206/542, 44 R; 190/12 A, 18 A

[56] References Cited

U.S. PATENT DOCUMENTS

| | | | |
|---|---|---|---|
| 654,841 | 7/1900 | Sabin-McDonald | 248/461 |
| 1,652,984 | 12/1927 | Hixson . | |
| 3,145,966 | 8/1964 | Landon . | |
| 3,165,367 | 1/1965 | Rose . | |
| 3,378,322 | 4/1968 | Johnson . | |
| 3,799,488 | 3/1974 | Sena . | |
| 3,809,354 | 5/1974 | Phifer . | |
| 4,042,203 | 8/1977 | Warkentin . | |
| 4,054,315 | 10/1977 | Czarnowski . | |
| 4,057,215 | 11/1977 | Stettler . | |
| 4,372,630 | 2/1983 | Fuhri | 248/461 |
| 4,453,470 | 6/1984 | Capella . | |
| 4,925,147 | 5/1990 | Potter . | |
| 5,004,204 | 4/1991 | Cook . | |
| 5,040,762 | 8/1991 | Potter . | |

FOREIGN PATENT DOCUMENTS

| | | |
|---|---|---|
| 134010 | 9/1951 | Sweden . |

*Primary Examiner*—Kenneth J. Dorner
*Assistant Examiner*—Gerald A. Anderson

[57] ABSTRACT

A transportable easel is self contained within a box that holds the workpiece support and tray for paints and brushes. A detachable wheeled tripod support folds up against the box for storage and may be used to roll the box and collapsed easel to the desired location.

10 Claims, 6 Drawing Sheets

TRANSPORTABLE EASEL

BACKGROUND OF THE INVENTION

1. Field of the Invention

This invention relates to an artist's easel that includes its own carrying case, wheels for transport all of which fold into a compact, easily transportable unit.

2. Description of the Related Art

Easels for artists may be used in remote places. This means that they must be carried over possibly difficult terrain, along with the canvas, paints, brushes and the like. It should be transportable, without being so light that it provides little support.

U.S. Pat. No. 3,145,966 issued Aug. 25, 1964 to Landon discloses a portable easel having a compartment 30 with a drawer 37 for storing supplies. Each leg comprises telescoping sections 17 and 18, and the canvas support comprises telescoping members, tube 22 and rod 23. The unit is collapsible to facilitate portability and can be carried by handles 40 (see FIGS. 1 and 2).

U.S. Pat. No. 4,054,315 issued Oct. 18, 1977 to Czarnowski discloses a table assembly for wheelchairs having support means 47 and 49 for supporting an artist's canvas or board. The table has a horizontal tray member 16 with upright sides 21 and front 22. Leaves 23 are hingedly mounted at the top edge of sides 21 so that the leaves can be moved between a closed and opened position. The assembly can be carried as a box when closed.

U.S. Pat. No. 5,040,762 issued Aug. 20, 1991 to Potter discloses a collapsible artist's easel having a yoke 47 with wheels 56 and 57. FIGS. 3 and 4 show the yoke 47 in the extended and relaxed state respectively. FIG. 5 shows the easel being wheeled in the direction of arrow A.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

SUMMARY OF THE INVENTION

The invention provides an artist's easel and paint box in its own carrying case that may be folded compactly for storage or partially set up for transporting on wheels.

BRIEF DESCRIPTION OF THE DRAWINGS

A detailed description of the invention is hereafter described with specific reference being made to the drawings in which.

DESCRIPTION OF THE PREFERRED EMBODIMENTS

The transportable easel 10 of the invention basically consists of three sections, the artwork support 12, box 14, and tripod support 16.

Tripod Support Construction

Figure 5:
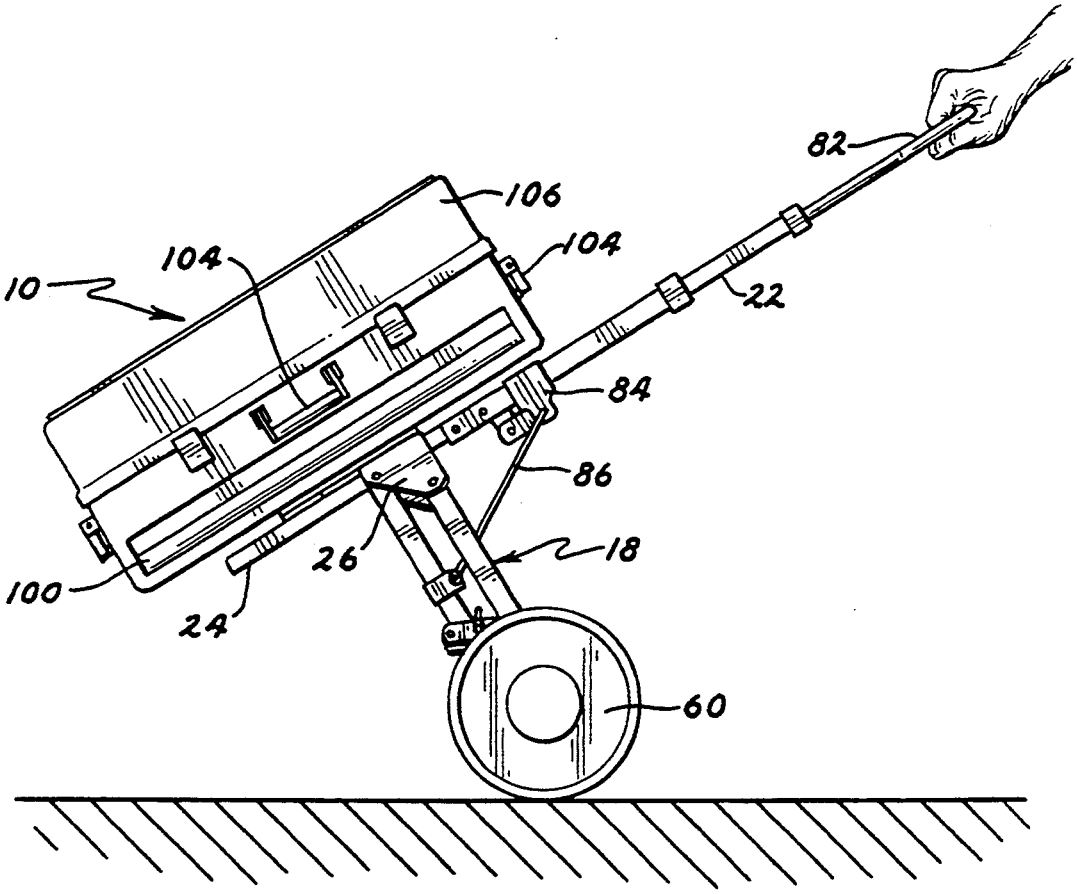
FIG. 5 is a side elevational view showing the easel being transported by its handle.
Figure 2:
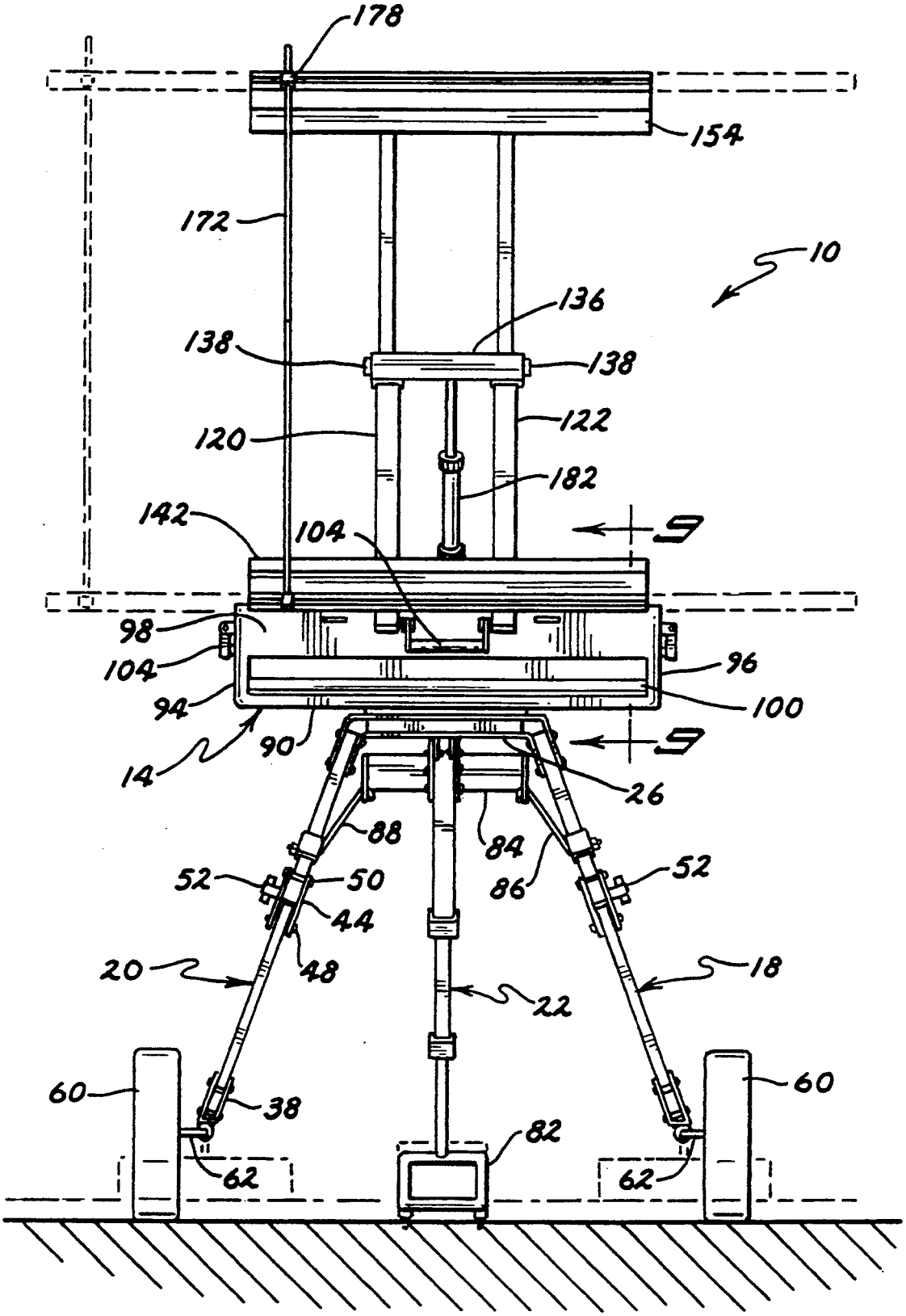
FIG. 2 is a front elevational view of the easel with phantom lines to show the folding wheels and extendibility.
Figure 3:
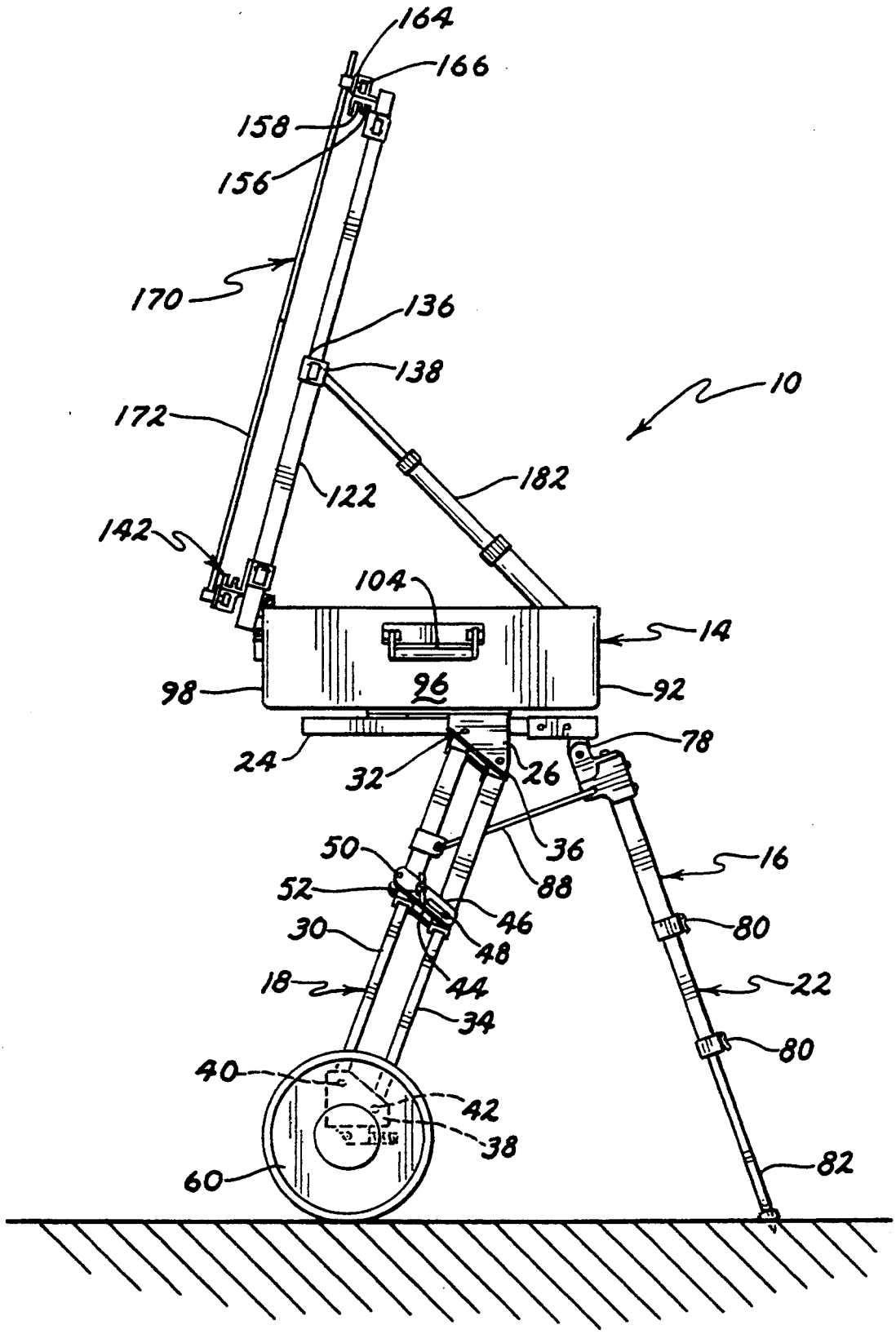
FIG. 3 is a side-elevational view of the easel.

As best shown in FIGS. 2, 3 and 5, the easel 10 includes a tripod support 16 consisting of two double strut telescoping legs 18, 20 and a third leg/handle 22. All three legs depend from a tripod base member 24. The legs 18, 20 are each formed from a double telescoping strut with a four pin pivot arrangement. The legs 18, 20 are connected to a top bracket 26, which in turn is connected to the tripod base member 24. The rear telescoping strut 30 of each leg 18, 20 is hingedly mounted to the top bracket 26 by a pin 32 as is the forward telescoping strut 34 by a second pin 36. The bottom of each telescoping strut 30, 34 is hingedly mounted to a bottom bracket 38 via a rear 40 and forward pin 42. This arrangement ensures that the double strut arrangement is kept whether the legs 18, 20 are extended for painting or folded out of the way for transport.

The length of the struts 30, 34 is held by a height bracket 44 which includes a slot 46 that is used to keep a pin 48 on the forward strut 34 slidably captive. The rear strut 30 includes a pin 50 to hold the bracket 44 thereto. Application of a frictional force such as from a wingnut/bolt 52 arrangement between the outside and inside portions of the bracket 44 prevents the legs from telescoping when they must be fixed.

Figure 8:
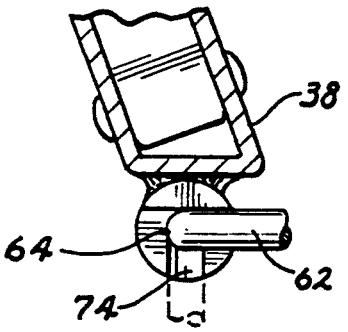
FIG. 8 is a fragmentary view of the axle hub of FIG. 7 taken across line 8—8.
Figure 7:
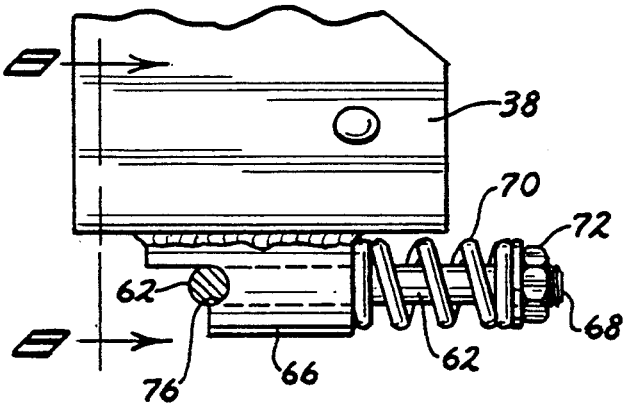
FIG. 7 is a fragmentary detail of the wheel axle hub.
Figure 6:
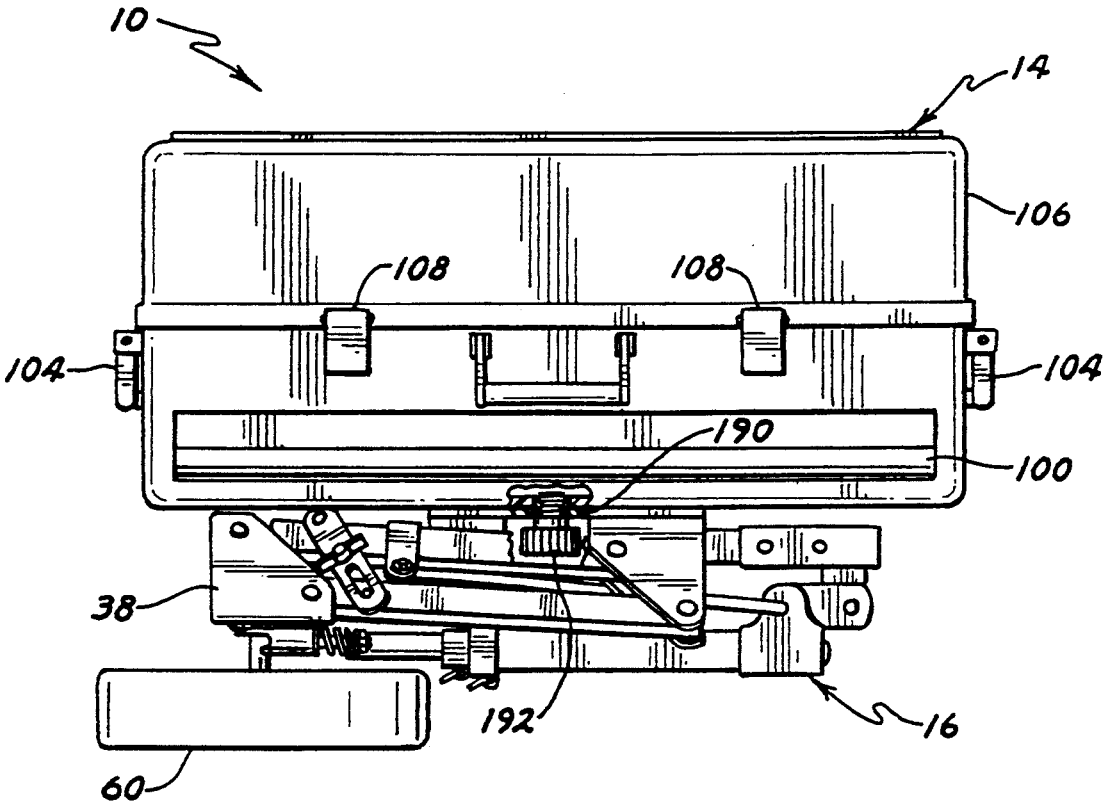
FIG. 6 is a front elevational view of the easel in its fully retracted position for storing in a trunk.

Each leg 18, 20 includes a wheel 60 that is held to an L-shaped axle 62 as shown in FIGS. 7 and 8. The axle 62 is held within the bore 64 of an axle keeper 66. An end 68 of the axle 62 is threaded and includes a spring 70 and nut 72. The axle keeper 66 includes two detent grooves 74, 76. Pulling on the wheel 60 against the force of the spring 70 allows the axle 62 to move from one detent groove to the other, being locked in place normally by the spring. This allows the wheels to be folded as shown in FIGS. 2 and 6.

The third leg 22 of the tripod is hingedly mounted to the tripod base 24 by a hinge member 78. The third leg 22 is telescopic and includes adjustment members 80 to fix the length as desired. The end of the third leg 22 is a pulling handle 82 as shown in FIG. 5. The third leg 22 is also connected to a an interconnecting bar 84 between the rear struts via a pair of support rods 86, 88. This improves stability of the tripod.

The tripod base member 24 is attached to the bottom of the box 14. Preferably, the connection is detachable and rotatable such that the box may be rotated relative to the tripod or removed. A simple camera-like bayonet mount or mount of a camera to a tripod may be employed. FIG. 6 shows a threaded recess 190 in box 14. A simple threaded bolt 192 extending through an opening in the tripod base member 24 may make the connection. When loosened, but not removed, the box 14 may rotate relative to the base member 24.

Box Construction

Figure 1:
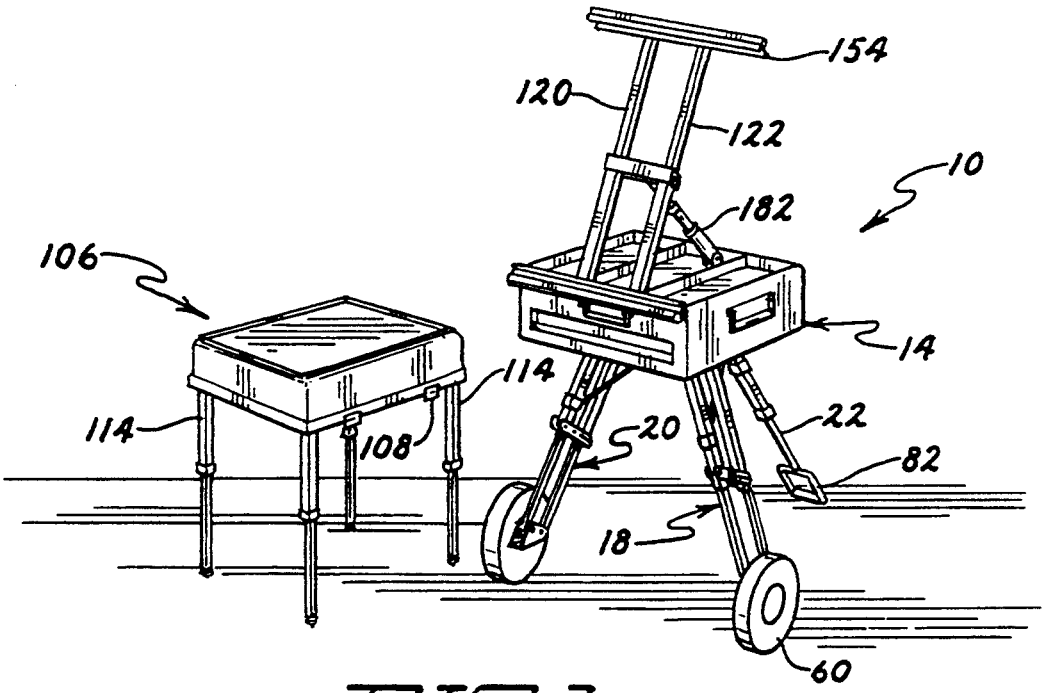
FIG. 1 is a perspective view of the transportable easel set up with its cover.
Figure 4:
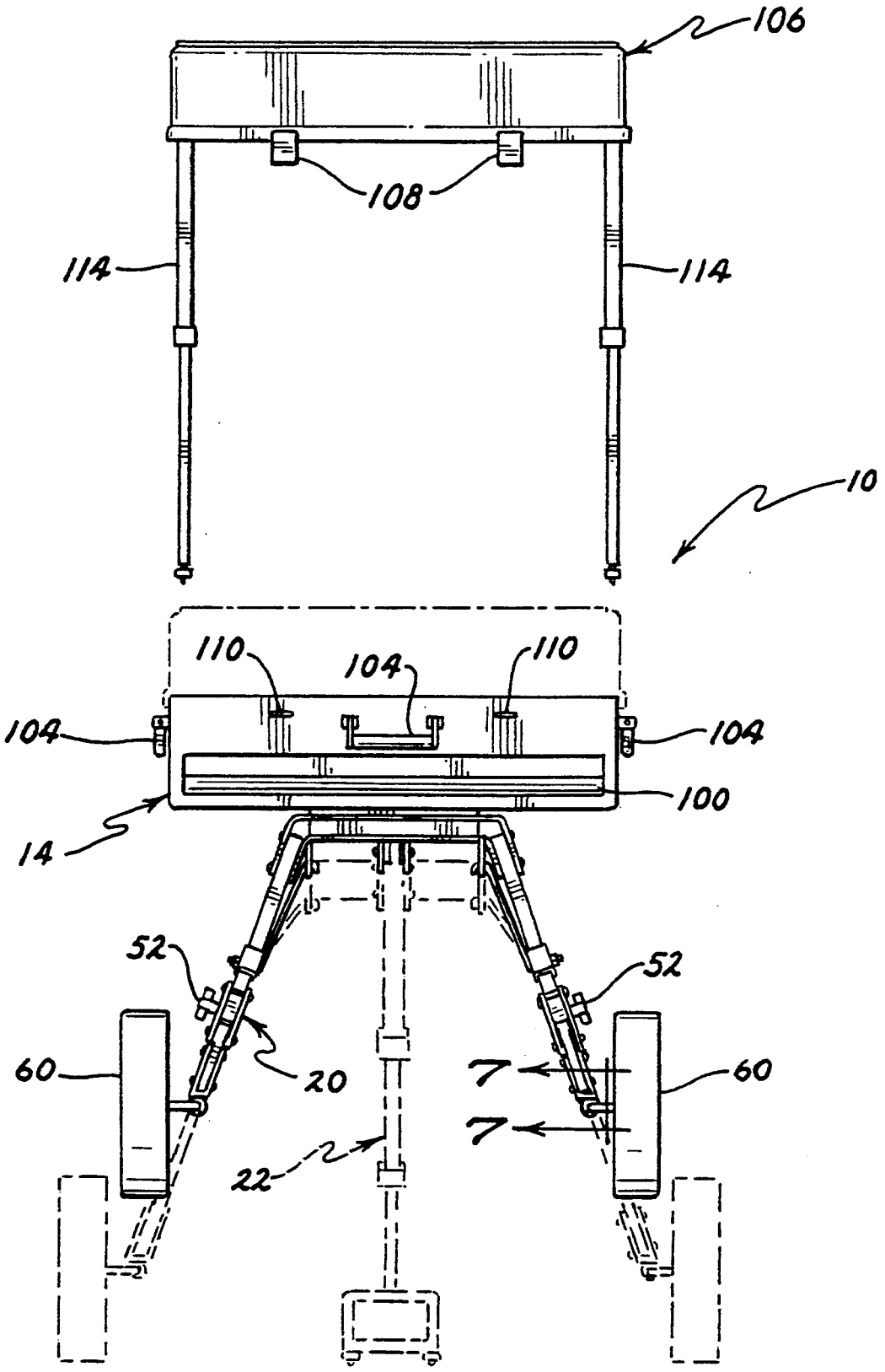
FIG. 4 is a front elevational view of the easel partial broken down for transport, phantom lines showing full extension and cover location.
Figure 9:
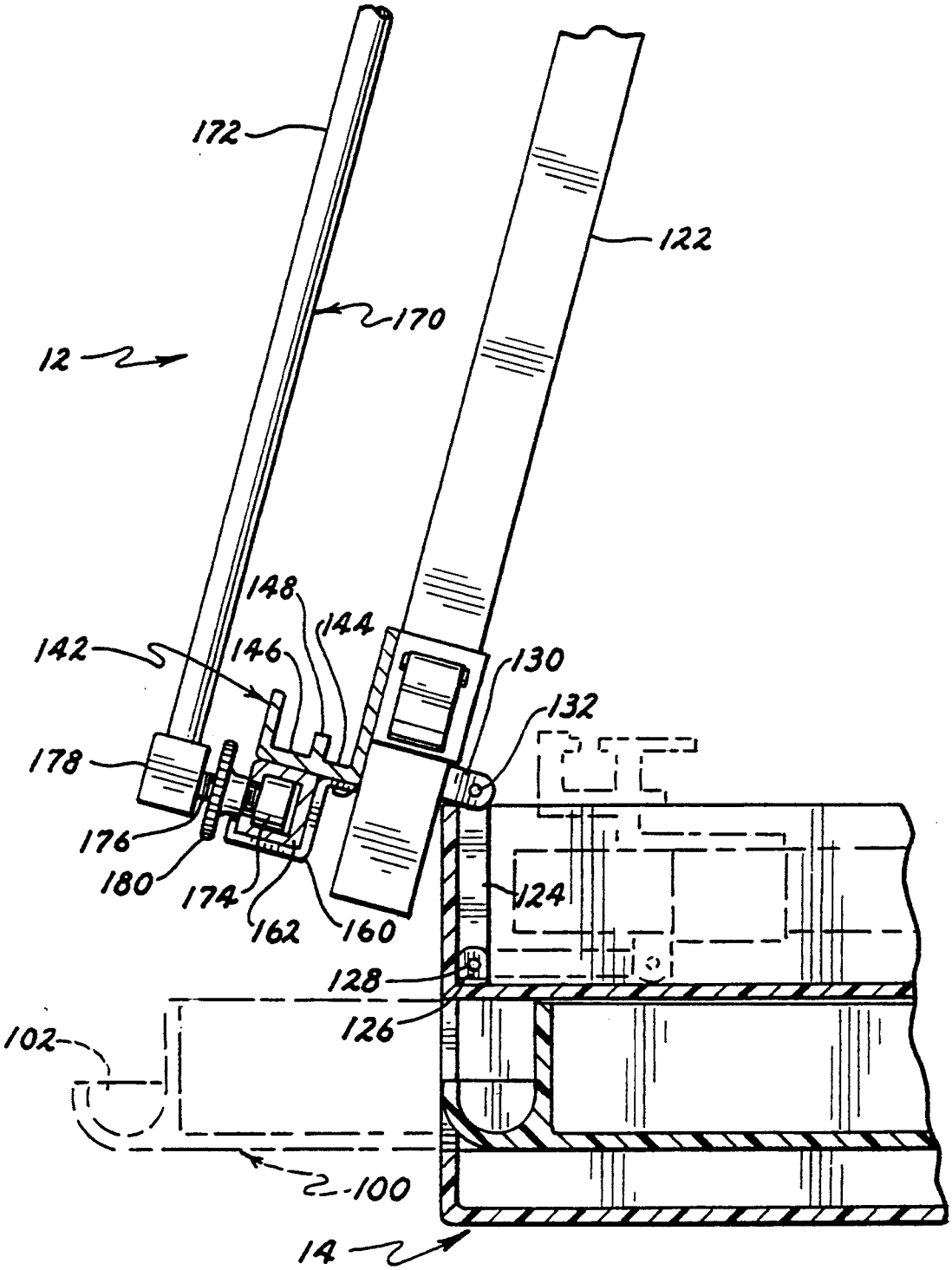
FIG. 9 is a partial side elevational view of the easel box showing the tray in phantom and the canvas support as its fold into the box.

Box 14 includes a bottom 90, back wall 92, side walls 94, 96 and a front wall 98. It further includes at least one pull out drawer 100 as best shown in FIG. 9. Drawer 100 may include a pencil tray 102 and may be divided into distinct trays. It slides in and out of the box as is customary in fishing tackle boxes. Box 14 includes at least one handle 104 by which the box itself may be carried. The box is closed for transportation by a cover or lid 106 as shown in FIGS. 1, 4 and 5. Lid 106 includes a plurality of latches 108 that mate with latches 110 on the box 14. When latched together, the lid 106 is secured to the box 14.

Finally, as shown in FIGS. 1 and 4, the lid 106 may include four telescoping legs 114 which may fold inside the lid as in cardtables. This allows the lid to be used as a small table as shown in FIG. 1 or even as a chair, if built solidly enough to carry a person's weight.

Artwork Support Construction

The artwork support 12 is carried by and folds into the box 14. Artwork support 12 includes a pair of generally parallel, spaced vertical telescoping members 120, 122. The members are each hingeally attached to the box interior as shown in FIG. 9 via a strap 124 hingedly joined via pin 126 to a box support 128 and a vertical member support 130 and pin 132. As shown by the phantom lines in FIG. 9, the vertical members 120, 122 may be laid flat within the box.

The telescoping members 120, 122 include a horizontal cross-piece 136 that provide rigidity to the framework and carries the telescoping limiting mechanism 138 which serves to set the members 120, 122 telescoped height where desired.

The bottom of the members 120, 122 includes a lower channel shaped cross-member 142 fastened to each member. It defines at least one upwardly facing channel into which a workpiece may be positioned. Two channels 144, 146 are illustrated. Channel 144 can be sized to hold a masonry board, typically of ¼ inch thickness, while channel 146 may be larger to hold canvas stretched on a frame. If the channel separator 148 is constructed as shown in FIG. 9, a third widest channel is effectively formed between the outermost lips of the cross-member channel 142.

The top of the members 120, 122 includes an upper channel shaped cross-member 154 constructed like the lower cross-member 142 except that its channels 156, 158 face downward. A workpiece is held between the cross-members 142, 154 within a channel after the height of the vertical members 120, 122 is adjusted to fit.

It will be appreciated that the cross-members are of a length such that they will fit within the box when the vertical members 120, 122 are folded down into the box. With reference to FIGS. 2, 3 and 9, it will be seen that the cross-members 42, 154 may include additional horizontal members. A lower clip 160 is attached to the lower cross-member 142 and slidably captures a c-channel member 162. Similarly, the upper cross-member includes an upper clip 164 and a c-channel member 166. Both c-channel members 162, 166 are able to slide back and forth in their clips to positions shown in phantom lines on FIG. 2. A slide mechanism 170 is positioned to the clips and c-channels and a telescoping wrist support rod 172 is connected therebetween. The slide mechanism 170 includes a wheel 174 held within the c-channels which in turn is connected via a threaded shaft 176 to rod connectors 178. A thumb-wheel 180 may be adjusted to fix the wheel 174 to the c-channel or released to allow the wrist support rod to be moved to the right or left.

In operation, the user releases the upper, lower or both thumb-wheels and slides the wrist support to the left or right as shown by the phantom lines in FIG. 2. If the workpiece is larger than the width of the box, this provides support over the extended positions. The wrist of the user may rest on the rod 172 to be more comfortable and to stay off the workpiece. It should be noted that the wrist support rod may be diagonal relative to the ground, since the telescoping construction allows it to increase in length for diagonal positions.

The artwork support 12 may be set up to whatever angle is desired by attaching a telescoping angle rod 182 to the horizontal cross-piece 136. The other end of rod 182 may be hingedly connected to the interior of the box 14 so that it can fold away for transport. Alternatively, it may simply be a support prop that can be collapsed and stored in the box.

In use, the collapsed transportable easel 10 is removed from the trunk or other storage location in the form shown in FIG. 6. The three legs are folded out at least partially for wheeling to the desired location as shown in FIG. 5. The lid 106 is removed after the latches are opened and the legs 114 are folded out and extended to set up the cover as a table. The transportable easel is then set to height by adjusting each of the three legs. It is noted that FIG. 2 shows that the wheels may be rotated 90 degrees so they cannot roll, providing even more stability to the tripod support.

The artwork support 12 is then pulled out of the box via hinge straps 124 and the telescoping angle rod 182 is pulled up and adjusted to the length desired which sets the angle of the easel support from the vertical. The vertical members 120, 122 are then adjusted in height by the telescope limiting mechanism 138 to the height needed for the framed canvas with the frame in the channels.

Paints, brushes and the like may be pulled from the drawer 100. Other items may be rested on the cover 106 (in table form). If a leg is in the way, the connection between the box and tripod support may be loosened to swivel the box and artwork support to a different position before re-tightening. Alternatively, if a suitable table permits, the box may be removed from the tripod and set on any flat surface. In this manner, the tripod is not used except for transport. FIG. 1 shows the typical setup of the inventive easel.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A transportable artist's easel comprising:

(a) a box with a removable lid;

(b) a tripod base attachable to said box;

(c) an artwork support comprising opposing parallel upper and lower channel-shaped members spaced from and held to adjustable length vertical members such that a workpiece may be secured between and by said channel-shaped members, said artwork support being hingedly mounted to the interior of said box and constructed and arranged to fold completely into said box; and (d) said lid including at least three spaced table legs attached to said lid such that when said lid is removed from said box, the lid may function as an elevated table surface.

2. The transportable artist's easel of claim 1 wherein said box is constructed and arranged to include at least one pull-out drawer for carrying art supplies.

3. A transportable artist's easel comprising:

(a) a box with a removable lid;

(b) a tripod base attachable to said box; and (c) an artwork support comprising opposing parallel upper and lower channel-shaped members spaced from and held to adjustable length vertical members such that a workpiece may be secured between and by said channel-shaped members, said artwork support being hingedly mounted to the interior of said box and constructed and arranged to fold completely into said box, said tripod base including two legs having wheels positioned at the leg ends and a third leg including a handle member.

4. The transportable artist's easel of claim 3 wherein said tripod base legs are telescoping and are hingedly mounted to a tripod base member such that the legs may be collapsed in length and folded up against said box for storage.

5. The transportable artist's easel of claim 3 wherein said wheels include a hinged axle member such that said wheels may be rotated 90 degrees.

6. A transportable artist's easel comprising:

(a) a box with a removable lid;

(b) a tripod base attachable to said box; and (c) an artwork support comprising opposing parallel upper and lower channel-shaped members spaced from and held to adjustable length vertical members such that a workpiece may be secured between and by said channel-shaped members, said artwork support being hingedly mounted to the interior of said box and constructed and arranged to fold completely into said box, said artwork support including a telescoping rod captively held at each rod end to said upper and lower channel-shaped members by adjustable slide members, said adjustable slide members being movable from one position to another on said upper and lower channel-shaped members such that the telescoping rod is positionable anywhere across a workpiece held to said artwork support for an artist to use as a wrist-rest.

7. An artist's easel comprising:

(a) an artwork support comprising opposing parallel upper and lower channel-shaped members spaced between at least one adjustable-length vertical members such that a workpiece may be secured between and by said channel-shaped members;

(b) a box having a bottom and side walls defining a space, a cover to close said box, said artwork support being hingedly connected to the interior of said box and being constructed and arranged to fold completely into said box; and (c) said cover including at least three spaced table legs attached to said cover such that when said cover is removed from said box, the cover may function as an elevated table surface.

8. The artist's easel of claim 7 further including a tripod support comprising three adjustable length legs hingedly mounted to a tripod support base, said tripod support base being connected to the box bottom.

9. The artist's easel of claim 7 wherein said box is constructed and arranged to include at least one pull-out drawer for carrying art supplies.

10. An artist's easel comprising:

(a) an artwork support comprising opposing parallel upper and lower channel-shaped members spaced between at least one adjustable-length vertical members such that a workpiece may be secured between and by said channel-shaped members; and (b) a box having a bottom and side walls defining a space, a cover to close said box, said artwork support being hingedly connected to the interior of said box and being constructed and arranged to fold completely into said box;

(c) a tripod support comprising three adjustable length legs hingedly mounted to a tripod support base, said tripod support base being connected to the box bottom; wherein two of said legs include wheels, and the third leg includes a handle such that said third leg may be used via the handle to wheel the easel to another location.

* * * * *